United States Patent [19]

Kelly

[11] 3,958,421

[45] May 25, 1976

[54] ROTARY CLOSED PARALLEL CYCLE ENGINE SYSTEMS

[76] Inventor: Donald A. Kelly, 58-06 69th Place, Maspeth, New York, N.Y. 11378

[22] Filed: Jan. 8, 1974

[21] Appl. No.: 431,624

[52] U.S. Cl. ..... 60/517; 60/659

[51] Int. Cl.[2] ..... F02G 1/04

[58] Field of Search ..... 60/508, 516–526, 60/659

[56] References Cited

UNITED STATES PATENTS

| | | | |
|---|---|---|---|
| 3,074,229 | 1/1963 | Baas et al. | 60/525 |
| 3,509,718 | 5/1970 | Fezer et al. | 60/525 X |
| 3,516,245 | 6/1970 | Kelly | 60/519 |
| 3,535,872 | 10/1970 | Kelly | 60/519 |

*Primary Examiner*—Allen M. Ostrager

[57] ABSTRACT

The rotary closed parallel cycle engine system consists of multiple rotary units which are mounted together axially for a combined power output.

The rotary units follow a modified Stirling cycle with each eccentric rotor and multi-vaned unit independent from adjacent units, so that gas leakage in any one unit does not disable the engine system.

Heat transfer is accomplished by a large number of small diameter transfer tubes formed into wide loops on either side of the engine units.

Hydrogen is the internal working gas, and hydrogen is also advocated as the engine fuel source.

4 Claims, 4 Drawing Figures

ROTARY CLOSED PARALLEL CYCLE ENGINE SYSTEMS

BACKGROUND OF THE INVENTION

The rotary closed parallel cycle engine is similar to the previously disclosed series cycle rotary units with large loop transfer tubing between the hot and cold sides of each engine unit.

The previously described rotary closed series cycle engine system outlined in Disclosure Document No. 018274, contains a design inconsistancy of having the first unit to the last unit transfer tubing connection unequal to the normal diagonal tubing connections.

Although this design discrepancy can be satisfactorily resolved, it does entail some compromises and difficulty in arranging the long tubing runs in relation to the manifolds on both thermal sides of the rotary units.

The series gas flow arrangement and inconsistant tubing runs require that the tubing groups be made up and connected as one unit assembly, since they are not all identical and independent. The most serious deficiency in the series connection arrangement is that an internal gas leak occuring in any one of the rotary units will cause a loss of power in the engine system, due to the unit to unit gas flow.

The present parallel and independent transfer tubing arrangement avoids these problems, with all identical tubing runs and groups connected to the hot and cold manifolds of the same unit, directly across the axis of the engine system.

Each rotary (expander) unit operates in a similar way to a closed loop turbine (Brayton cycle), since the vanes are non-contacting with the cylinder walls, but unlike the turbine expander have a moderate compression ratio similar to that of the piston expander, (Stirling cycle).

An important factor in the effective operation of the rotary units is the critical application of ball bearings to each vane of each rotor so that the vanes are guided and controlled in their radial clearance with the cylinder bores. Friction and wear are thereby minimized and the rotary expander units operate at high efficiency.

The engine system will operate at high gas flow rates for a closed gas cycle because of the low friction expander and low internal gas flow resistance.

Hydrogen or helium gas will be the working medium for the engine system, which have been used successfully in Stirling piston engines recently. Hydrogen gas is advocated as a prime fuel source for the engine system due to its many advantages and availability.

Summary of the Invention

The rotary closed parallel cycle engine system consists of multiple, identical rotary units of the basic Ramelli eccentric rotary pump configuration. The basic improvement over the conventional rotary pump is the addition of two ball bearings on either side of each vane, for lower friction and wear. The vane ball bearings roll within corresponding concentric grooves within each end plate disc, so that radial vane clearance is kept to a minimum consistant with an optimum compression ratio for the units.

The parallel and independent multiple tubing grouping avoids the problems of the series arrangement, with all identical tubing groups connected directly to the hot and cold manifolds of each unit at right angles to the engine system axis.

A relatively large number of small diameter tubing runs connect the two manifolds of each unit in a wide loop arrangement for adequate heat transfer from the heating and cooling sources.

One side half of the tubing loops are contained within a burner housing, while the opposite side half of the tubing loops are in contact with circulating coolant tubing and fins for heat sinking and cooling of the gas flow.

Multiple vertical layers or tiers of tubing loops are utilized to improve heat transfer density and overall engine system compactness.

Since the gas flow path within the engine system is unidirectional (uniflow) normal Stirling cycle reciprocating regeneration is not possible, but thermal economization and storage are practical for the rotary system, to partially offset the loss of high efficiency regeneration.

Economization is possible by extending the heating and cooling transfer surfaces to the expansion and contraction halves of the cylinders, and by splitting the cylinders and insulating them from each other for improved thermal isolation.

Heat storage is also useful, by placing a sealed housing containing a thermally active chemical directly over the hot manifold to provide long heating and containment over the entire hot side of each rotary unit within the engine system.

Because of the imposition of a thermal potential on each unit cylinder, the gas flow will be from the hot side (expansion) to the cold side (contraction) of each unit cylinder with the working gas (helium or hydrogen) being uniformly and alternately heated and cooled in parallel, or independent from other adjacent units within the system.

An important component for the proper operation of the engine system is the gaseous return pump which maintains the return gas flow rate and keeps a positive pressure on the hot expanding gas within the hot section, so that full expansion occurs within the expansion phase of the cycle.

This component was overlooked in the previous series cycle system and must be included to provide for effective operation by maintaining a return pressure on the gas and in isolating the two thermal phases of the cycle.

The return pump tends to isolate the two thermal phases of the cycle by the use of insulators at the tubing group entrances and exits.

It is a critical feature of the return pump that it be a low inertia type which operates at high speed, so that it does not impose a high power takeoff from the system. Each rotary unit will have its own return pump so that the unitized or modular system is maintained.

A pressure snubber will be placed at the return pump outlet, toward the hot side to insure that the return pump is relieved of pressure surges which may occur within the system during startup and stopping. The pressure snubber would not function during steady state operation but would snub or restrain sudden pressure surges which may occur.

Because the rotary units are parallel or independent, each unit will have its own heating shell, economizer and coolant tubing arrangement, with all possible cross-connections made external to the units or modules.

The enclosed heating shell covers the hot-half portion of the transfer tubing loops, with multiple burners maintaining the required heat flow over the transfer tubing. Thermal storage material (chemical) is uniformly located within the burner housing to maintain long heating residence and containment within the shell. The heat storage chemical will be contained in compartments adjacent to the hot transfer tubing loops with heat flow channels provided from the lower burners under the entrance portion of the hot loops.

Additional heat storage chemical compartments will be located above the tubing loops to contain some of the rising heat flow from the lower burners.

A combined liquid and moving air cooling means must be utilized for the cold-half portion of the transfer tubing loops.

Matching small diameter liquid coolant tubing lines will be in tangent contact with each transfer tube, with uniformly placed cooling fins assembled over the combined tubing, which also serve to secure the tubing lines together.

Forced air cooling will be provided over the combined tubing lines by means of one or several fans driven by power takeoffs or by electric motors.

A gas pressure reservoir is included for the engine system to vary the working pressure of the gas on demand, so that speed/torque output of the system are quickly variable. Pressure controls are located adjacent to the reservoir with provision for remote control from the operators location.

Each unit will be connected to adjacent units by splined or flexible couplings, with a front drive shaft and rear accessory shaft provided. Each unit will be secured to the adjacent units by quick-mounts consisting of fixed L brackets, spacers and matching hardware.

A starter motor (electric) will be connected to the rear shaft for starting the engine and an alternator and drive arrangement will be included to complete the system.

An alternate arrangement of the transfer tubing loops is shown in the drawings, which allows for a lower placement of the burner housing to maintain more heat flow over the hot cylinder halves. The tubing loop configuration is optional, and depends to a large extent on fabrication convenience and limitations.

A large preheater unit must also be placed over the hot portion of the transfer tubes between or over the pressure snubber and the burner housing, to allow for the preheating of the entering gas flow from the return pump.

The preheater is connected to the burner units through the burner shell by means of a sealed duct, or large tubing run.

Expansion type tubing may be provided for the cooling side loops whereby uniformly increasing diameters of tubing are joined going toward the return pump at the top center of the engine system.

The spent gas from the cold manifold will be uniformly expanded and therefore caused to cool more effectively than through constant diameter tubing. The wall thickness of the progressively increasing diameter tubing will be reduced corresponding to the pressure drop within the tubing sizes, to aid in more rapid transfer through the cooling tubing runs.

Circulating coolant tubing can also be used with this arrangement to hasten heat sinking, and improving the gas temperature drop.

It is a principal object of the invention to produce a rotary closed cycle engine system which converts heat energy into mechanical power, at the best possible cost/effectiveness ratio. All other objectives of the invention have been defined in the background and summary descriptions of the specifications.

It should be understood that variations may be made in the detail design of the rotary engine system, without departing from the spirit and scope of the invention, as specified.

A Disclosure Document has been filed in the Patent Office which briefly describes this rotary engine system, and which now forms a part of the specifications.

The following issued U.S. Pat. Nos. also contain pertinent design features similar to this present invention:-

1. No. 3,370,418 — Rotary Stirling Cycle Engine
2. No. 3,492,818 — Rotary Stirling Cycle Engine
3. No. 3,537,256 — Rotary Stirling Engine
4. No. 3,488,945 — Rotary Stirling Cycle Engine

DESCRIPTION OF THE PREFERRED EMBODIMENT

Figure 1:
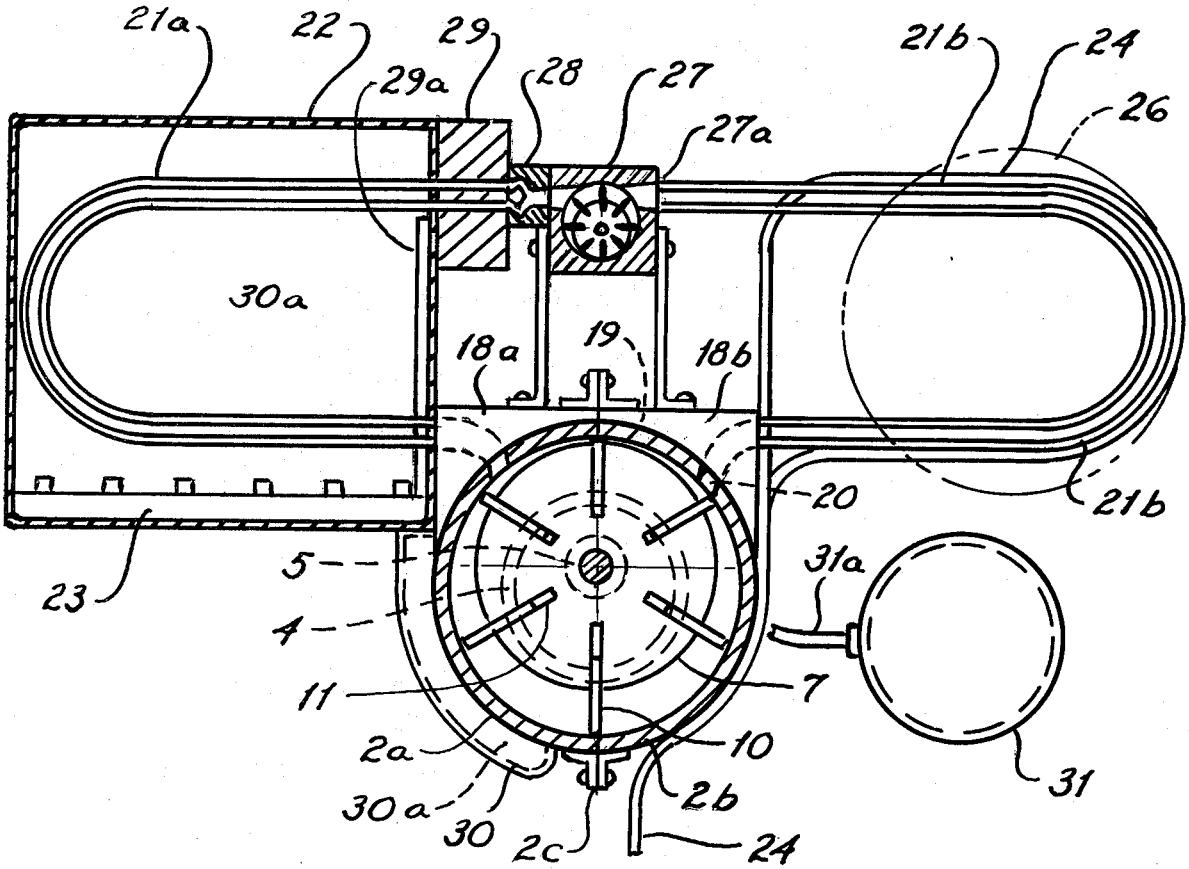
FIG. 1 is a front sectional view through the rotary closed parallel cycle engine system.
Figure 2:
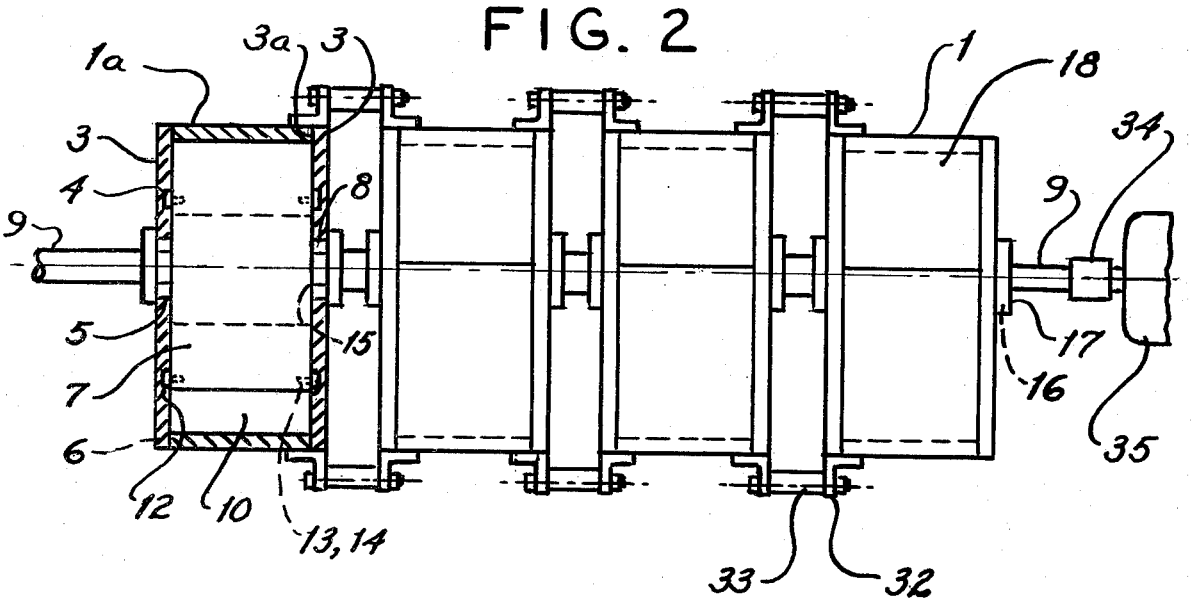
FIG. 2 is a side elevation view of the rotary closed parallel cycle engine system.
Figure 3:
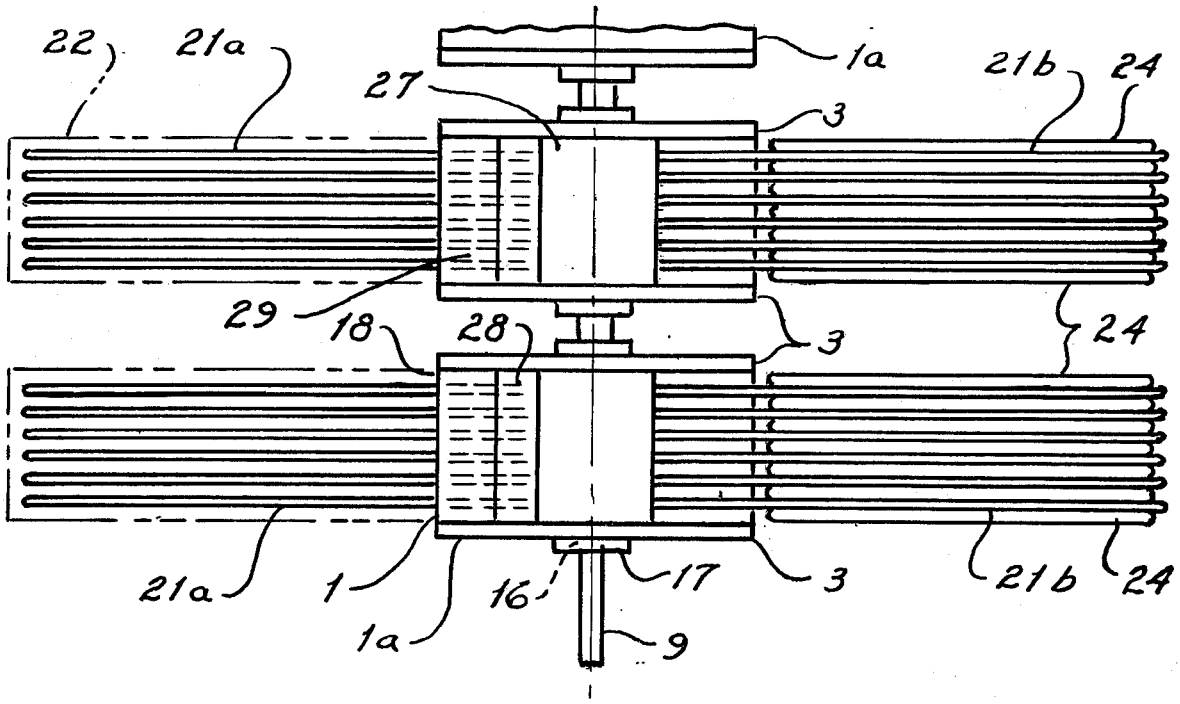
FIG. 3 is a top view of the rotary closed parallel cycle engine system.
Figure 4:
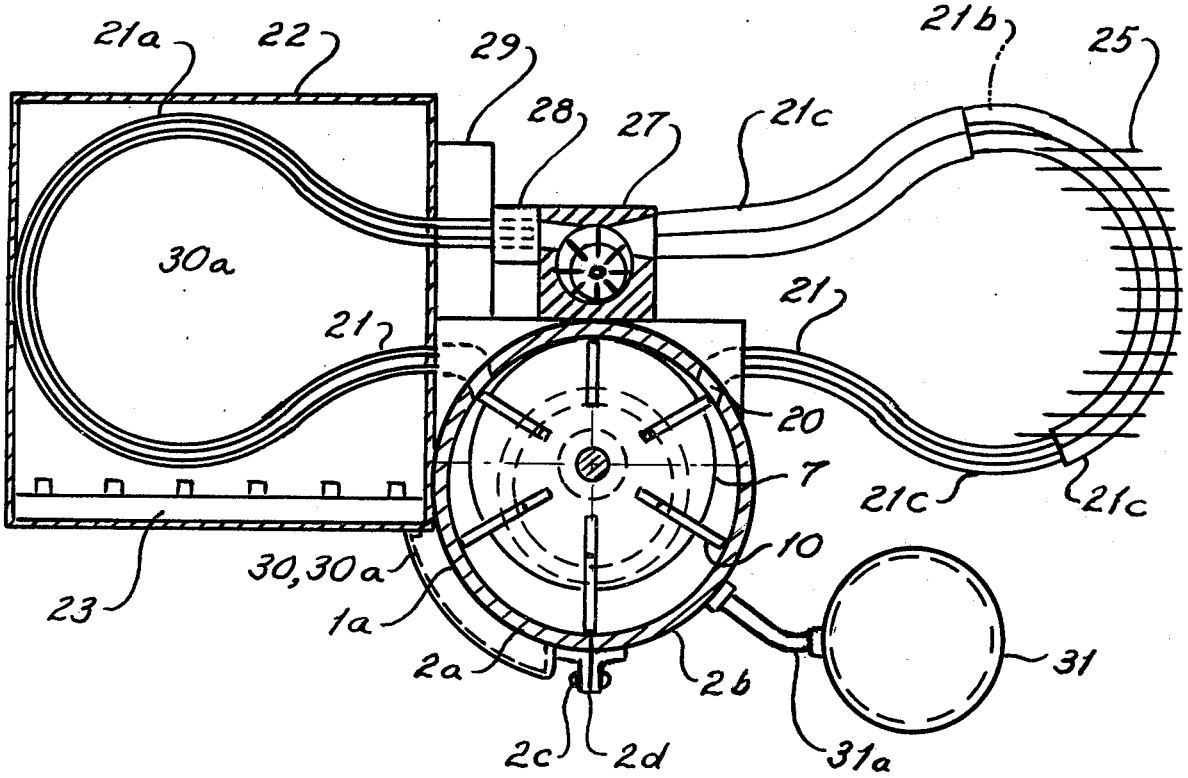
FIG. 4 is an alternate front sectional view through the rotary closed parallel cycle engine system.

The rotary closed parallel cycle engine system 1, is comprised of individual rotary units or modules 1*a*, which are mounted together axially to provide a combined power output.

Each unit 1*a*, is made up of two true cylinder halves 2*a*, and 2*b*, along with two identical end plates 3.

The end plates 3, are provided with concentric internal circular grooves 4, which serve as guide tracks for rolling ball bearings on each vane. The plates 3, also contain identical bearing bores 5, along with fastening holes 6, which are uniformly located around the periphery of the end plates.

Each rotary unit 1*a*, contains a close fitting, freely revolving slotted rotor 7, which is supported by two needle bearings 8, located within the bearing bores 5, by means of the drive shaft 9.

Multiple, identical hollow vanes 10, are uniformly fitted into corresponding slots 11, within the slotted rotor 7. Two identical ball bearings 12, are located in-line, at the sides of each vane 10, and secured to the vanes 10, by the pins 13, and set screws 14.

Each ball bearing 12, is in rolling contact with the circular grooves 4, so that the multiple vanes 10, are guided with limited radial travel as the rotor 7, revolves within the cylindrical housing 2. The ends of each vane clears the housing bore by a range of from 0.005 to 0.025 inch, for a moderate compression factor.

Thin, low-friction spacers 15, are utilized between the rotor 7, and the two identical end plates 3, which are positioned on the drive shaft 9, and allow running clearance for the rotor 7. The side clearance for each vane 10, is maintained by the closed fitting ball bearings 12, in relation to the face of the circular grooves 4.

Gas pressure seals 16, are located within sealing plates 17, which are secured to the outside faces of the two identical end plates 3.

Two identical manifolds 18, are secured at the upper sides of the cylindrical housings halves 2*a* and 2*b*, with the screws 19. Rectangular ports 20, are located within the upper sides of the cylinder halves 2*a* and 2*b*, which exactly line up with the two identical manifolds 18.

Multiple small diameter transfer tubes 21, connect the hot side manifold 18*a*, with the cold side manifold 18*b*, of the same rotary unit 1*a*. The multiple transfer tubes 21, and divided into the hot side loops 21*a*, and cold side loops 21*b*.

A burner housing 22, is utilized for each cylinder half 2*a*, which is connected to the side surface of the hot side manifold 18*a*. Multiple burners 23, are secured within the burner housing 22, to provide the necessary heat flow for the hot side loops 21*a*.

Multiple cooling tubes 24, are in tangent contact with the multiple cold side loops 21*b*, along with multiple flat fins 25, which secure the cooling tubes 24, to the cold side loops 21*b*. Cooling fan(s) 26 provide a forced cooling air flow over the multiple flat fins 25, and cold side loops 21b.

A gas return pump 27, which is a low inertia, eccentric rotor and vane type, is utilized to circulate the gas flow from the cold side loops 21*b*, to the hot side loops 21*a*. The return pump is mounted directly above the center of each rotary unit 1*a*, is preferrably driven by a power takeoff from the drive shaft 9.

Insulated bushings 27*a*, connect each hot side loop 21*a*, and cold side loop 21*b*, to the gas return pump 27, to aid in thermal isolation of the thermal phases of the cycle.

A one-way flow gas snubber 28 is secured at the outlet side of the return pump 27, and provided pressure surge snubbing for the hot side loops 21*a*.

A preheater unit 29, is located between the gas snubber 28, and the burner housing 22, for gas preheating from the return pump 27. A connection duct 29*a*, connects the preheater unit 29, with the multiple burners 23.

A heat storage housing 30, containing a heat storage chemical 30*a* is located around the hot side manifold 18*a*, and lower cylinder halves 2*a*, for heat containment.

Heat storage chemical 30*a*, is also uniformly located within the burner housing 22, within containers or compartments 30*b*.

A variable pressure reservoir 31, is utilized for rapidly varying the working pressure of the gas, on demand. A pressure line 31*a*, connects the reservoir 31, with each of the rotary units 1*a*. Pressure regulators are placed adjacent to each rotary unit 1*a*, to control the internal pressure, with controls included for remote operation.

The rotary units 1*a*, are axially joined together at the output shafts 9, by flexible couplings or splines 34, with shaft extensions 9*a*, and 9*b*, for the front and rear connections, respectively.

Four outer brackets 32, are secured to the outer surfaces at the ends of the two cylinder halves 2*a*, and 2*b*, which position the spacers 33, for joining each rotary units 1*a*. Mountscrews and nuts connect the brackets 32, and spacers 33, together.

An electric starting motor 35, is connected to the rear shaft extension 9*b*, of the last rotary unit 1*a*, for starting the engine system.

The two cylinder halves 2*a*, and 2*b*, are joined together with the angles 2*c*, with an insulation strip 2*d*, placed between the cylinder halves 2*a*, 2*b*, and angles 2*c*.

The two end plates 3, are insulated from the two cylinder halves 2*a*, and 2*b*, by the circular gasket 3*a*.

In the alternate cooling arrangement, the cold side loops 21*b*, may be made up of uniformly increasing diameter tubing sections 21*c*, which allow for the expansion and further cool ing of the gas flow. The wall thickness of the tubing sections 21*c*, become correspondingly thinner, as the gas pressure drops, so that heat sinking is improved.

What is claimed is:

1. A rotary closed parallel cycle engine system comprising multiple identical rotary units consisting of rotors and vanes revolving within split cylindrical housings made up of two identical halves, multiple identical gas flow manifolds secured at the sides of said split cylindrical housings, multiple port means disposed at the upper sides of said split cylindrical housings made up of two identical halves, burner housings secured to the sides of one-half of said multiple identical gas flow manifolds, multiple burners uniformly disposed and secured within said burner housings, multiple small diameter gas transfer tubing formed in multiple wide loops in communication with and connected to said multiple identical gas flow manifolds, one-half of said multiple small diameter gas transfer tubing located inside of said burner housings and exposed to said multiple burners, one-half of said multiple small diameter gas transfer tubing in tangent contact with multiple liquid coolant tubing circuits from a liquid cooling source, one-half of said multiple small diameter gas transfer tubing in tangent contact with multiple liquid coolant tubing is made up of equal sections of uniformly increasing diameter from the multiple identical gas flow manifolds to the upper center of said multiple identical rotary units, multiple low-inertia rotary gas pumps disposed over the exact center of said multiple identical rotary units, one-half of said multiple small diameter gas transfer tubing is connected to one side of said low-inertia rotary pumps, one-half of opposite said multiple small diameter gas transfer tubing is connected to the other side of said low inertia rotary pumps, insulated bushings securing said multiple small diameter gas transfer tubing to both sides of said low inertia rotary pumps, gas pressure snubbing means secured to one side of said low-inertia rotary gas pumps.

2. A rotary closed parallel cycle engine system according to claim 1, including a variable pressure reservoir adjacent to said multiple identical rotary units, connection means from said variable pressure reservoir to each of said identical rotary units, regulation and control means for said variable pressure reservoir with remote actuation, hydrogen gas under pressure as the working medium for said rotary closed parallel cycle engine system.

3. A rotary closed parallel cycle engine system according to claim 1, wherein said multiple small diameter gas transfer tubing formed in multiple wide loops are made up in multiple rows and multiple concentric layers, thermal storage chemical uniformly disposed in compartments within said burner housings, thermal storage housing containing thermal storage chemical disposed over one-half of said multiple identical gas flow manifolds and said split cylindrical housings made up of two identical halves, preheating means disposed between said gas pressure snubbing means and said burner housings, duct communication means between said preheating means and said multiple burners, flue and insulation means uniformly disposed within said burner housing.

4. A rotary closed parallel cycle engine system according to claim 1, wherein said split cylindrical housings made up of two identical halves are joined together by identical angle pieces and secured by standard fastening means, insulation strips disposed between said angle pieces and said two identical halves, circular gasket insulation means disposed on either end of said said split cylindrical housings, multiple outer brackets secured to the outer end surfaces of said split cylindrical housings, multiple spacers disposed adjacent to said multiple outer brackets, standard fastening and sealing means utilized for joining and securing parts and components of said rotary units.

* * * * *